US006845692B2

(12) United States Patent
Cooper

(10) Patent No.: US 6,845,692 B2
(45) Date of Patent: Jan. 25, 2005

(54) LEVERAGE ADAPTER FOR USE IN COMBINATION WITH AN ELONGATED HAND TOOL

(76) Inventor: Donald W. Cooper, 7250 Ridge Lane Rd., Charlotte, NC (US) 28262

( * ) Notice: Subject to any disclaimer, the term of this patent is extended or adjusted under 35 U.S.C. 154(b) by 0 days.

(21) Appl. No.: 10/674,084

(22) Filed: Sep. 26, 2003

(65) Prior Publication Data

US 2004/0055428 A1 Mar. 25, 2004

Related U.S. Application Data

(63) Continuation-in-part of application No. 10/133,550, filed on Apr. 25, 2002, now Pat. No. 6,626,069.

(51) Int. Cl.[7] ..... B25G 1/04
(52) U.S. Cl. ..... 81/177.2; 81/177.85
(58) Field of Search ..... 81/177.2, 177.1, 81/177.5, 177.7, 177.75, 177.85, 125.1, 489, 491

(56) References Cited

U.S. PATENT DOCUMENTS

| | | | | |
|---|---|---|---|---|
| 522,181 | A | 6/1894 | Neal | |
| 1,463,077 | A | 7/1923 | Gandell | |
| 1,511,738 | A | 10/1924 | Lownsbery | |
| 2,142,589 | A | 1/1939 | Olson | |
| 2,490,739 | A | 12/1949 | Nesbitt | |
| 3,376,768 | A | 4/1968 | Fortunato | |
| 4,104,935 | A | 8/1978 | Stoops | |
| 4,324,030 | A | 4/1982 | Diaz | |
| 4,960,014 | A | 10/1990 | Kelley | |
| 5,535,649 | A | 7/1996 | Waggle, Jr. | |
| 5,832,794 | A | 11/1998 | Fowler | |
| 6,267,030 | B1 | 7/2001 | Rodoni | |
| 6,308,596 | B1 | 10/2001 | Williams | |
| 6,626,069 | B1 * | 9/2003 | Cooper | 81/177.2 |

* cited by examiner

*Primary Examiner*—David B. Thomas
(74) *Attorney, Agent, or Firm*—Schwartz Law Firm P.C.

(57) ABSTRACT

A leverage assembly is used in combination with an elongated hand tool. The hand tool has a first end adapted for engaging an object and a second end opposite the first end. The leverage assembly includes an adapter bar having first and second ends. A U-bolt attaches the first end of the adapter bar to the second end of the hand tool. A leverage bar engages the second end of the adapter bar. A receptacle is formed with the adapter bar for receiving the leverage bar. The leverage bar, adapter bar, and hand tool cooperate to multiply a force applied by the user to the object to manipulate the object.

16 Claims, 11 Drawing Sheets

Fig. 2
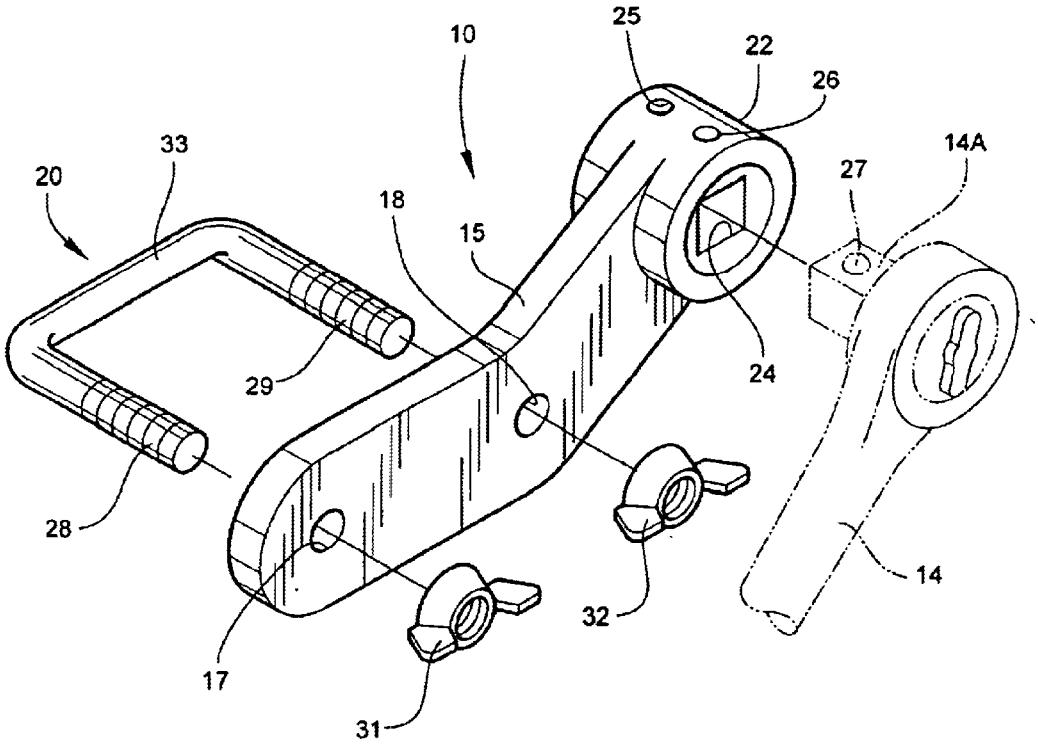
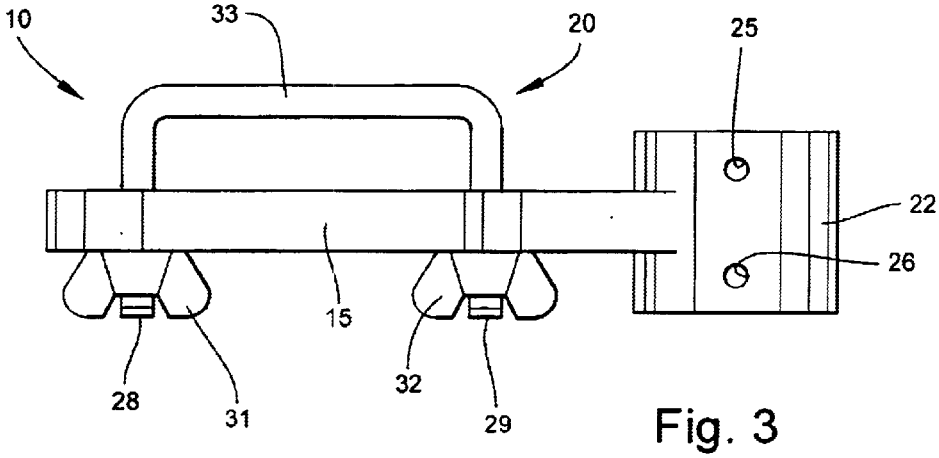
Fig. 3

LEVERAGE ADAPTER FOR USE IN COMBINATION WITH AN ELONGATED HAND TOOL

CROSS-REFERENCE TO RELATED APPLICATIONS

This application is a continuation-in-part of Application No. 10/133,550, filed on Apr. 25, 2002, now U.S. Pat. No. 6,626,069, issued Sep. 30, 2003.

TECHNICAL FIELD AND BACKGROUND OF INVENTION

This application relates to a leverage adapter for use in combination with a hand tool, such as a standard open-end or box wrench. The invention is especially application for use in industries, such as automotive repair, which require the manipulation of threaded nuts and other fasteners in tight areas. The invention quickly and conveniently extends the reach of the hand tool, and cooperates with the hand tool to increase leverage on the fastener.

SUMMARY OF INVENTION

Therefore, it is an object of the invention to provide a leverage adapter designed for use in combination with a standard hand tool in order to rotate threaded fasteners located in hard-to-reach areas offering little space for movement.

It is another object of the invention to provide a leverage adapter which readily extends the reach of a standard hand tool.

It is another object of the invention to provide a leverage adapter which serves to multiply the force applied to the threaded fastener being rotated.

These and other objects of the present invention are achieved in the preferred embodiments disclosed below by providing a leverage adapter for use in combination with an elongated hand tool. The hand tool has a first end adapted for engaging an object and a second end opposite the first end. The leverage adapter includes an adapter bar having first and second ends. Means are provided for attaching the adapter bar to the second end of the hand tool. The adapter bar includes means for receiving a leverage bar. The leverage bar, adapter bar, and hand tool cooperate to multiply a force applied by the user to the object to manipulate the object.

According to another preferred embodiment of the invention, the means for attaching the adapter bar includes a U-bolt extending through the first end of the adapter bar and adapted for engaging the second end of the hand tool to secure the adapter bar to the hand tool.

According to another preferred embodiment of the invention, a pair of wing nuts are applied to respective ends of the U-bolt.

According to another preferred embodiment of the invention, the wing nuts comprise respective integrally-formed washers.

Alternatively, the attaching means may include removable studs, pivoting swing arms, or any other structure suitable for releasably securing the hand tool to the leverage adapter.

According to another preferred embodiment of the invention, the second end of the adapter bar extends outwardly at an angle to the first end of the adapter bar.

According to another preferred embodiment of the invention, the means for receiving the leverage bar includes a receptacle formed in the second end of the adapter bar.

According to another preferred embodiment of the invention, the receptacle is generally square.

Alternatively, the means for receiving the leverage bar includes a square head. In this embodiment, the leverage bar has a socket end adapted for being applied to the square head of the adapter bar.

According to another preferred embodiment of the invention, the adapter bar is constructed of metal.

In another embodiment, the invention is a leverage assembly for use in combination with an elongated hand tool. The hand tool has a first end adapted for engaging an object and a second end opposite the first end. The leverage assembly includes an adapter bar having first and second ends. Means are provided for attaching the first end of the adapter bar to the second end of the hand tool. A leverage bar engages the second end of the adapter bar. Means are formed with the adapter bar for receiving the leverage bar. The leverage bar, adapter bar, and hand tool cooperate to multiply a force applied by the user to the object to manipulate the object.

According to another preferred embodiment of the invention, the means for receiving the leverage bar is a receptacle formed in the second end of the adapter bar.

Preferably, the receptacle is generally square.

According to another preferred embodiment of the invention, the leverage bar has a generally square head adapted for being received within the generally square receptacle of the adapter bar.

According to another preferred embodiment of the invention, the head of the leverage bar is a ratchet head.

In yet another embodiment, the invention is a method of multiplying a force applied by a user to an object to be manipulated. The method includes the steps of applying a first end of an elongated hand tool to the object. A leverage adapter is then attached to a second end of the hand tool. The leverage adapter is engaged using a leverage bar. A force is then applied to the leverage bar, such that the leverage bar, adapter bar, and hand tool cooperate to manipulate the object.

According to another preferred embodiment of the invention, the step of attaching the leverage adapter to the hand tool includes releasably clamping the leverage adapter and hand tool together.

BRIEF DESCRIPTION OF THE DRAWINGS

Some of the objects of the invention have been set forth above. Other objects and advantages of the invention will appear as the description proceeds when taken in conjunction with the following drawings, in which:

FIG. 2 is perspective view of the leverage adapter with the U-bolt and wing nuts removed, and showing a portion of the ratchet handle in phantom;

FIG. 3 is side elevational view of the leverage adapter in an assembled condition;

DESCRIPTION OF THE PREFERRED EMBODIMENT AND BEST MODE

Figure 1:
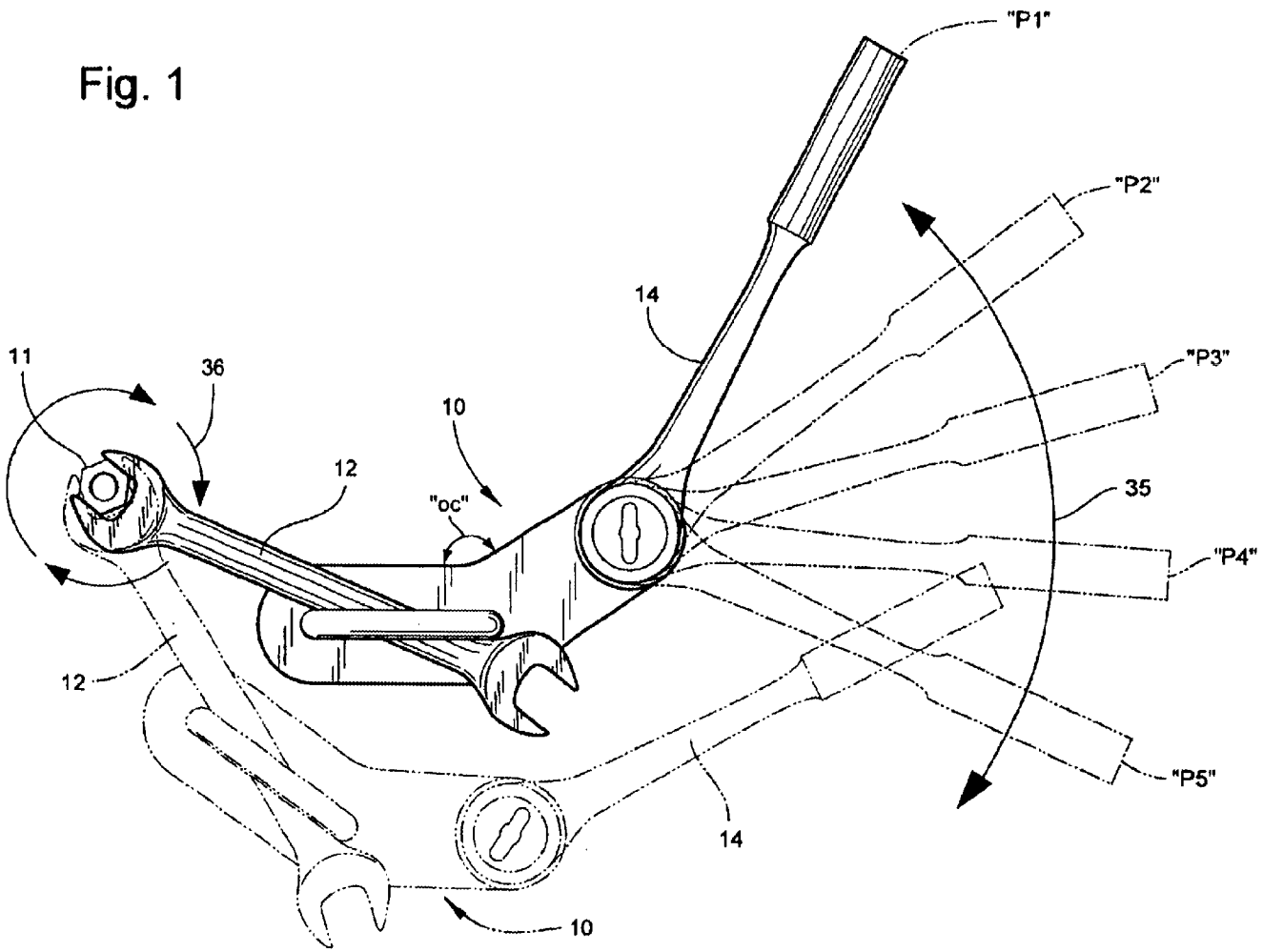
FIG. 1 is an environmental view of a leverage adapter according to one preferred embodiment of the invention, and showing the adapter cooperating with a hand tool and leverage bar to rotate a threaded nut in a clockwise direction.

Referring now specifically to the drawings, a leverage adapter according to the present invention is illustrated in FIG. 1, and shown generally at reference numeral 10. The leverage adapter 10 is used in combination with a hand tool and leverage bar in order to manipulate a threaded fastener, such as nut 11. In the embodiment shown, the hand tool is a standard open-end wrench 12. The leverage bar is a ratchet handle 14 of a standard ratchet wrench with a square head 14A (See FIG. 2) adapted for effective one-way ratcheting motion. In an alternative application, the leverage bar may be larger draw bar with a fixed square head.

Figure 4:
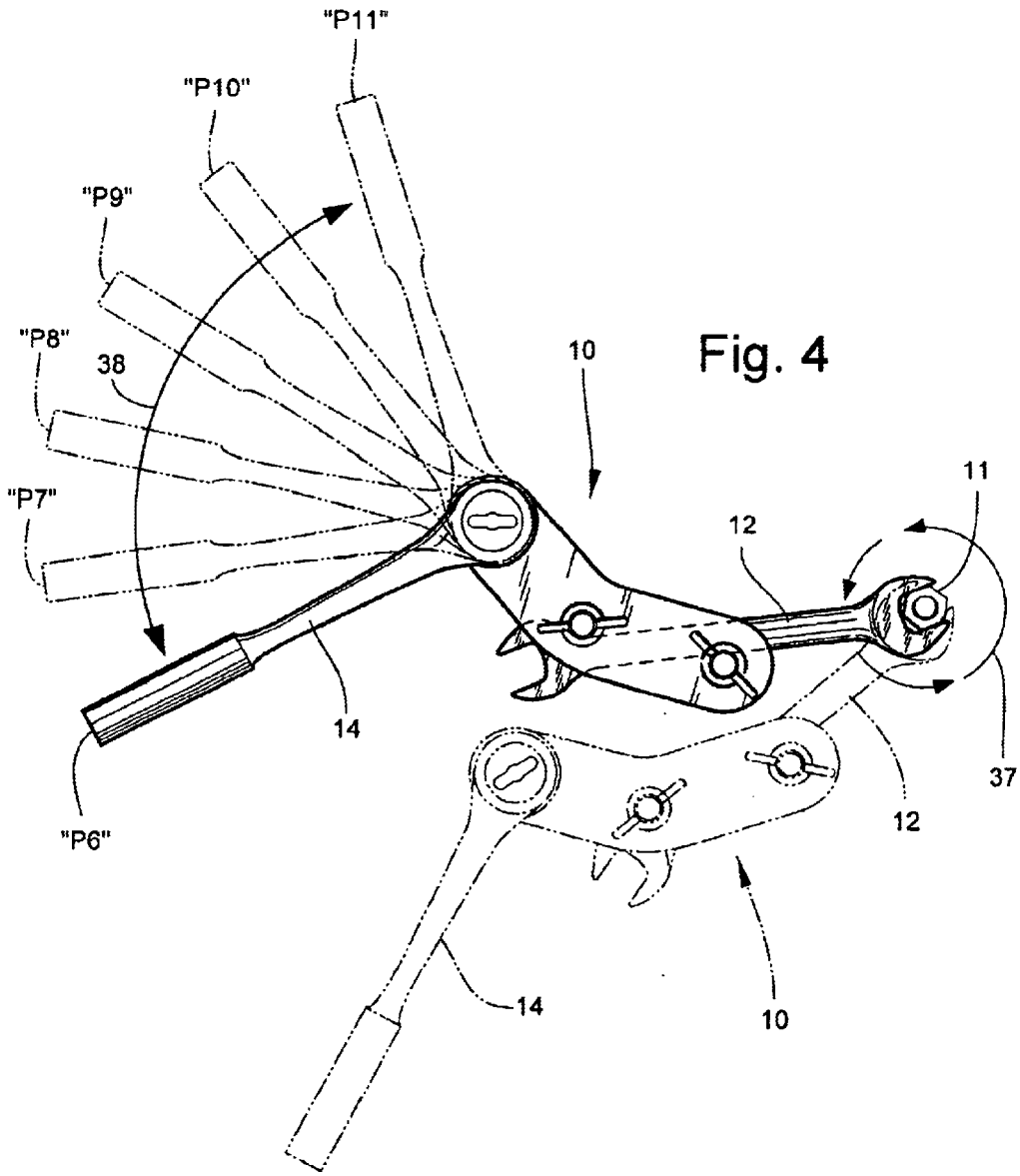
FIG. 4 is a second environmental view of the leverage adapter showing the leverage adapter cooperating with the hand tool and leverage bar to rotate the threaded nut in a counterclockwise direction.

As best shown in FIGS. 2 and 3, the leverage adapter 10 includes a generally flat elongated adapter bar 15 having first and second opposing ends. The first end defines spaced, annular openings 17 and 18 designed for receiving a U-bolt 20. The second end extends at an angle ($\alpha$) of approximately 120 degrees (See FIG. 1) to the first end, and defines an enlarged cylinder 22 with a generally square receptacle 24 passing entirely through the cylinder 22 and receiving the square head 14A of the ratchet handle 14. Small bearing holes 25 and 26 are preferably formed through the cylinder wall to accommodate a spring-loaded bearing 27 located in the square head 14A of the ratchet handle 14. The arms 28 and 29 of the U-bolt 20 are threaded, and mate with complementary-threaded wing nuts 31 and 32 to releasably and firmly secure the free end of the wrench 12 to the adapter bar 15, as shown in FIGS. 1 and 4. The wing nuts 31 and 32 are conveniently hand-tightened to clamp the wrench 12 between the cross member 33 of the U-bolt 20 and the adapter bar 15. The second end of the adapter bar 15 is sufficiently angled relative to its first end to avoid interfering engagement between the enlarged cylinder 22 and free end of the wrench 12.

Referring to FIGS. 1, 2, 3, and 4, with the wrench 12 and ratchet handle 14 operatively secured to the leverage adapter 10, as previously described, the working end of the wrench 12 is applied to the threaded nut 11. As indicated by arrow 35 shown in FIG. 1, the ratchet handle 14 is adjusted to any convenient fixed position, such as P1–P5, providing optimal leverage in limited space available for rotating the threaded nut 11 in a clockwise direction 36. The ratchet handle 14 and leverage adapter 10 extend the reach of the wrench 12, and cooperate to multiple the force applied to the nut 11. Preferably, the arms 28 and 29 of the U-bolt 20 bear directly against the wrench 12 during rotation. The integrally-formed cylinder 22 of the adapter bar 15 is sufficiently enlarged to allow 360-degree adjustment of the ratchet handle 14 without obstruction caused by the wrench 12 or cross member 33 of the U-bolt 20.

As shown in 4, to rotate the threaded nut 11 in an opposite counterclockwise direction 37, the square head 14A of the ratchet handle 14 is removed from the square receptacle 24 of the adapter bar 15, and the attached wrench 12 and leverage adapter 10 flipped over such that the arms 28, 29 of the U-bolt 20 extend outwardly away from the nut 11. The working end of the wrench 12 is then reapplied to the threaded nut 11, and the square head 14A of the ratchet handle 14 inserted into the opposite side of the square receptacle 24. The ratchet handle 14 is then adjusted as indicated by arrow 38 and fixed at a convenient position P6–P11 to provide optimal leverage. The ratchet handle 14 and leverage adapter 10 cooperate, as described above, to multiple the force applied the nut 11. The arms 28, 29 of the U-bolt 20 bear directly against the wrench 12 during counterclockwise rotation of the nut 11.

In an alternative application, an elongated socket extension may be applied to the square head of the ratchet handle, and the opposite end of the extension inserted into the square receptacle of the adapter bar. The socket extension may be especially applicable when working in hard-to-reach areas beneath the hood of a vehicle.

Figure 5:
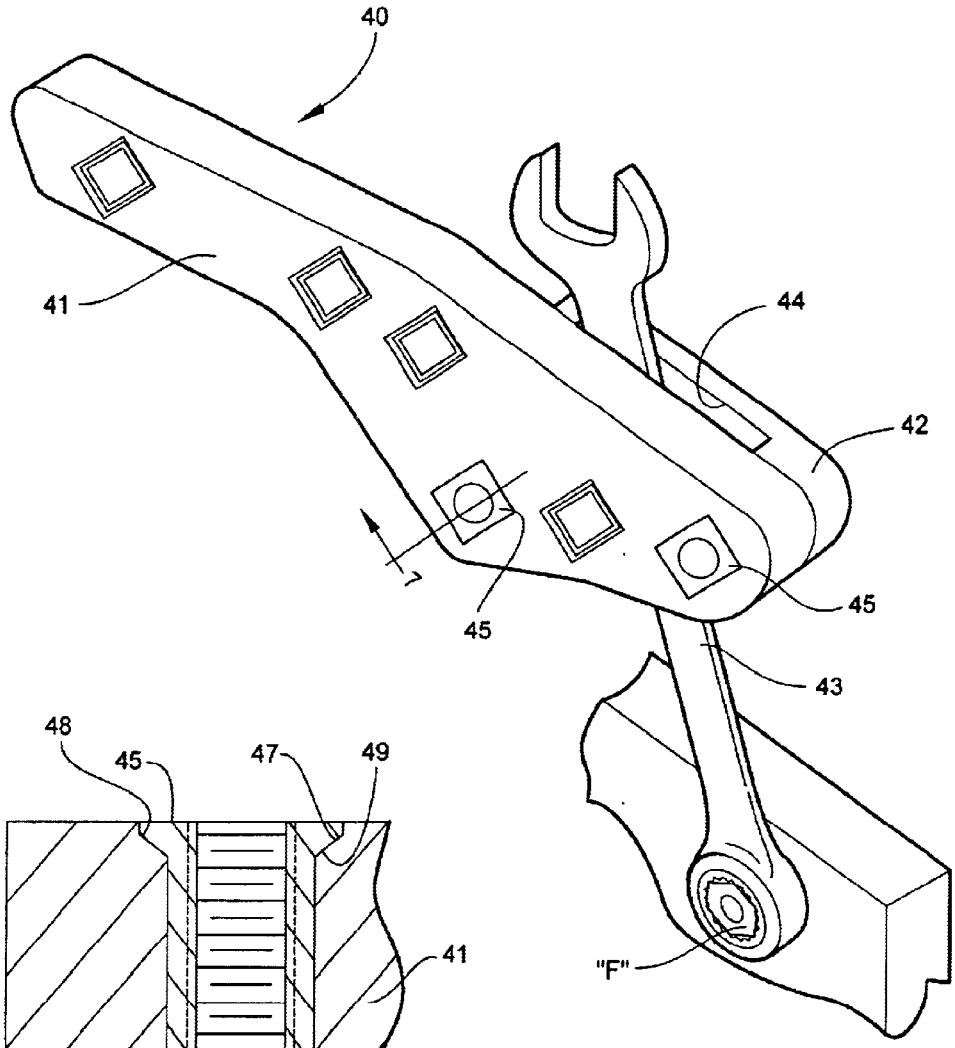
FIG. 5 is an environmental perspective view of a leverage adapter according to a second preferred embodiment of the present invention.
Figure 7:
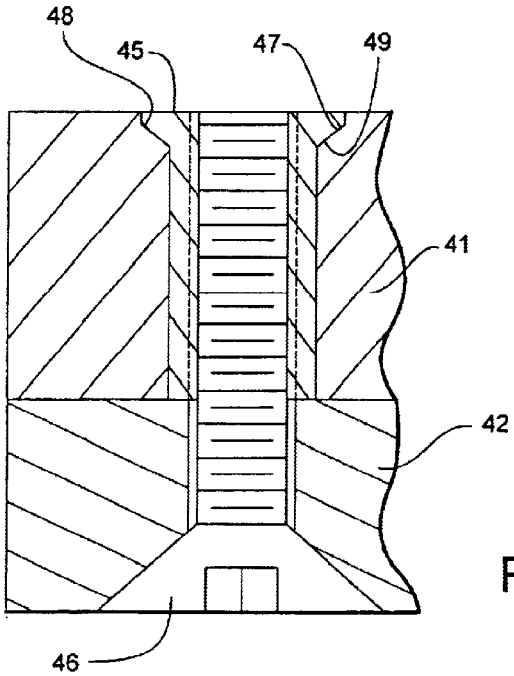
FIG. 7 is a cross-sectional view taken substantially at line 7 of FIG. 5.
Figure 6:
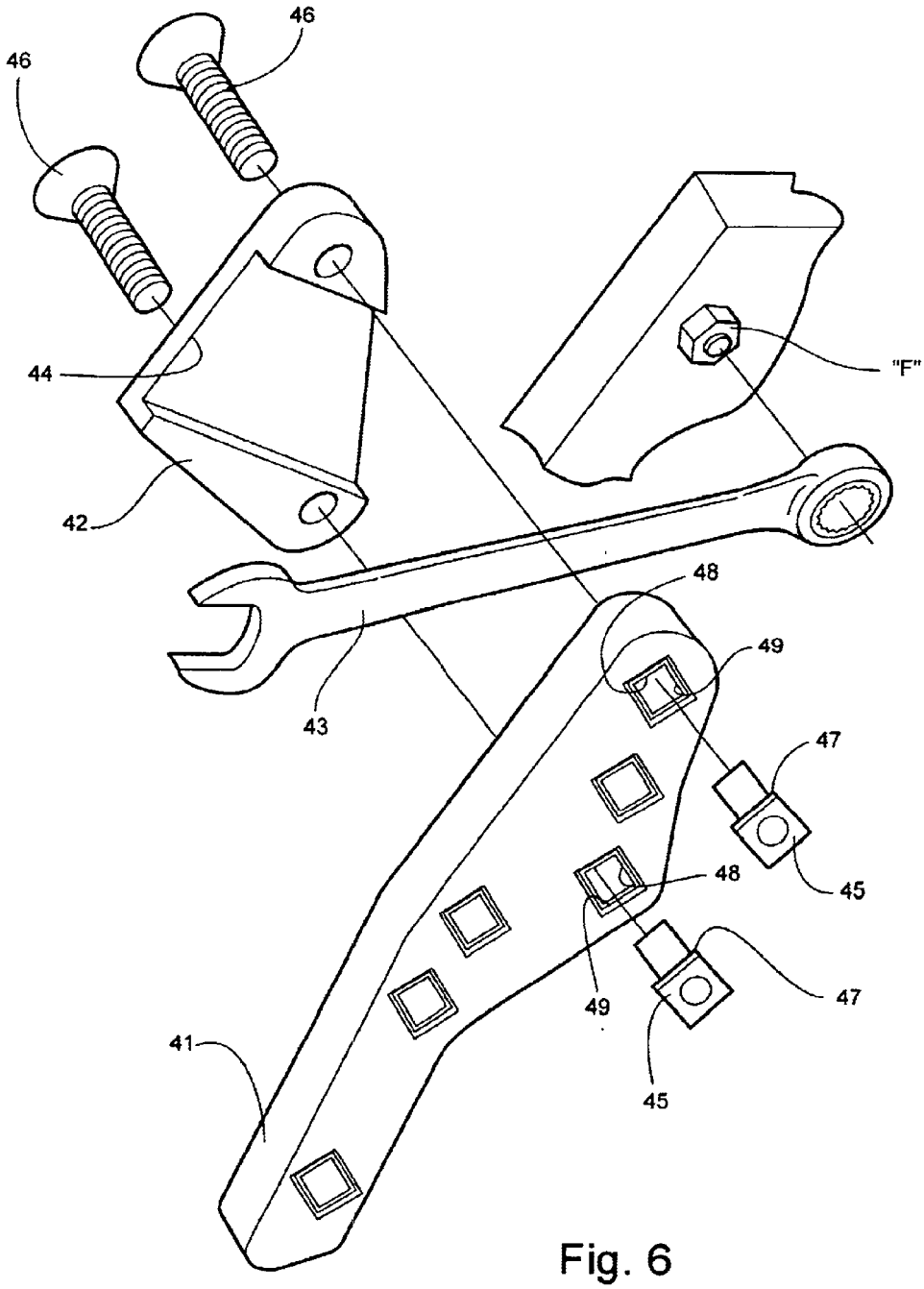
FIG. 6 is an exploded view of the leverage adapter shown in FIG. 5.

A second embodiment of the invention is illustrated in FIGS. 5–9. As best shown in FIGS. 5 and 6, the leverage adapter 40 includes a generally flat elongated adapter bar 41 and clamp plate 42 which cooperate when assembled to sandwich and secure one end of a wrench 43 to the adapter 40. Preferably, the clamp plate 42 defines an inside cut-out 44 designed to receive and accommodate the wrench 43. The clamp plate 42 and adapter bar 41 are held together by pairs of complementary-threaded nuts 45 and bolts 46. Each nut 45 has a generally square or rectangular shape, an internal screw thread, and a beveled lip 46. The nuts 45 are designed to fit within respective corresponding openings 48 in the adapter bar 41. As best shown in FIG. 7, the beveled lip 46 of the nut 45 mates with a slightly recessed shoulder 49 to properly seat and position the nut 45 within the opening 48.

Figure 8:
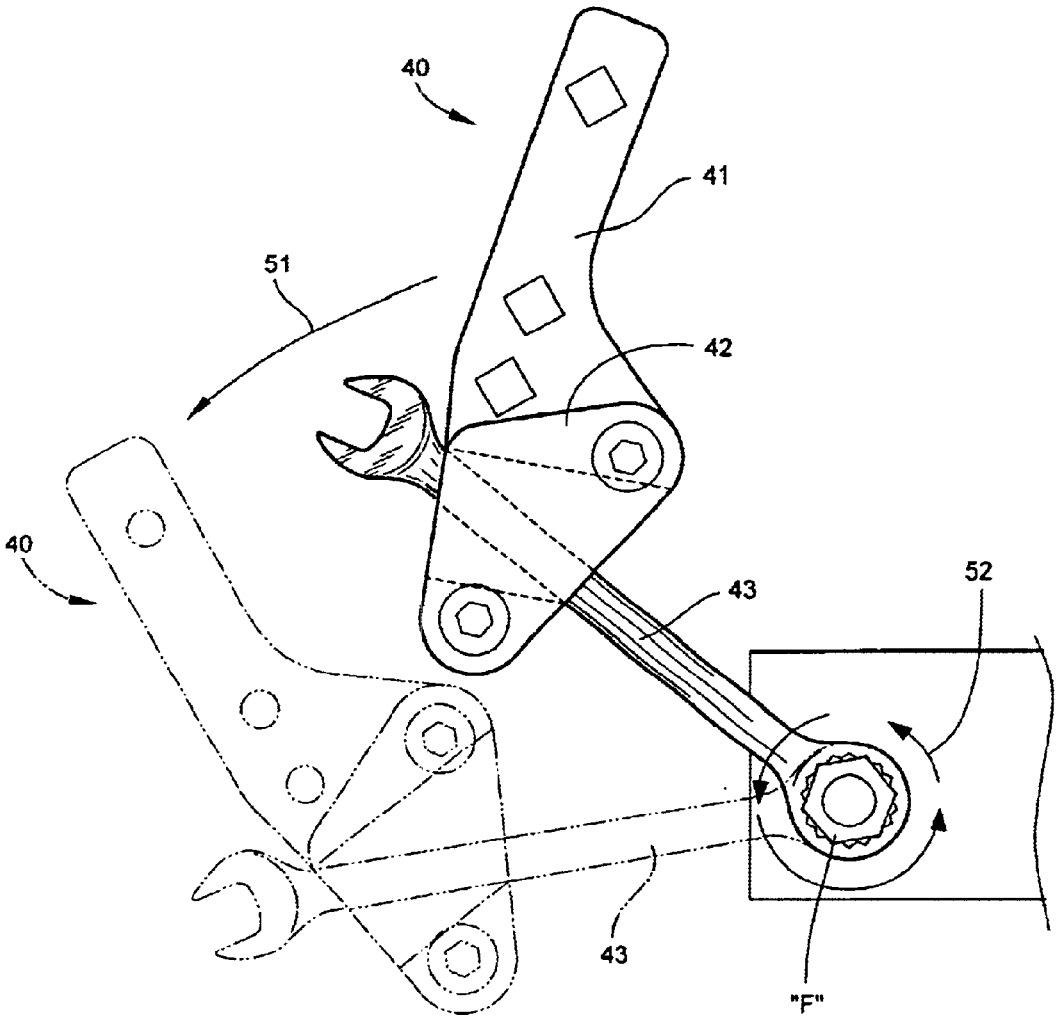
FIG. 8 is an environmental view demonstrating operation of the leverage adapter as applied to a fastener.
Figure 9:
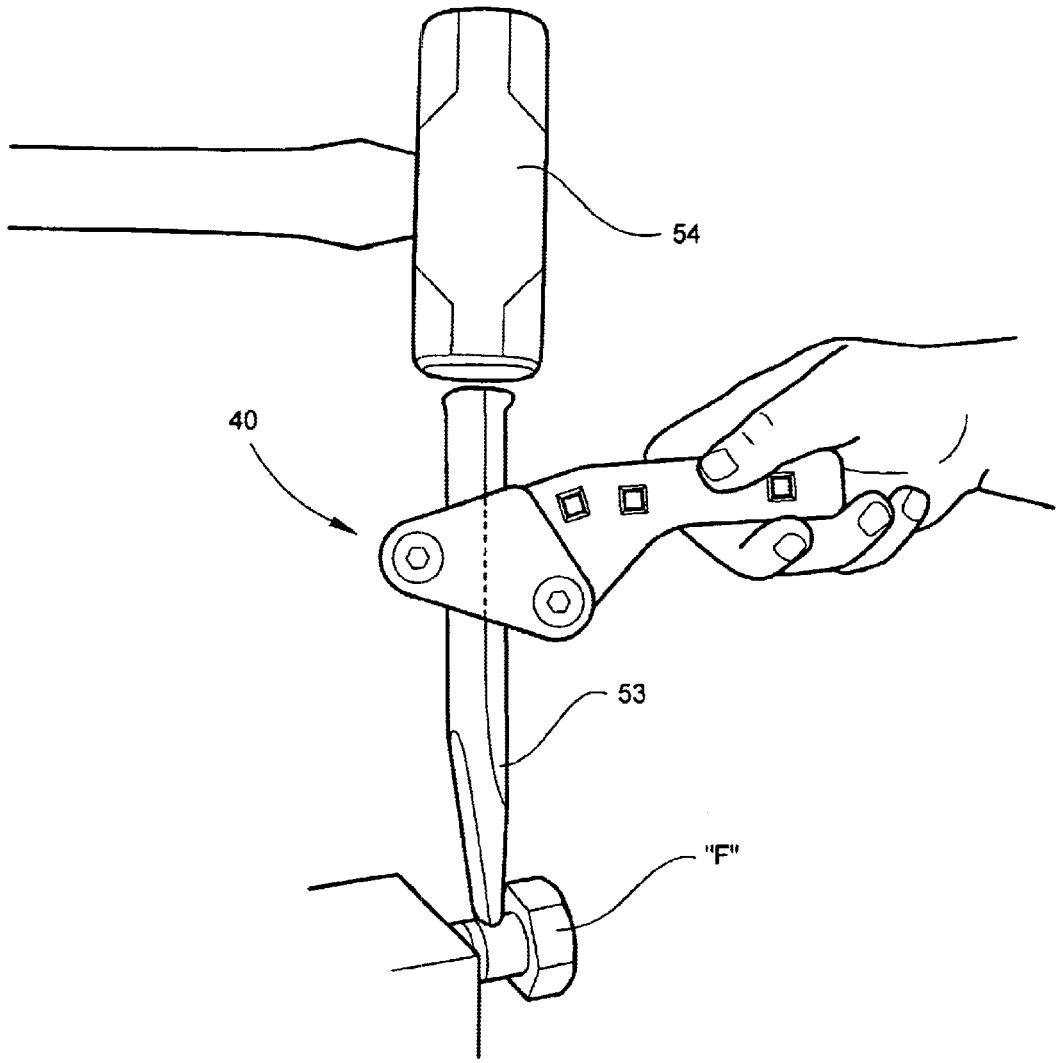
FIG. 9 is an environmental view demonstrating operation of the leverage adapter according to a further application of the invention.

With the leverage adapter 40 assembled and attached to the wrench 43, as shown in FIGS. 5 and 8, the opposite end of the wrench 43 is applied to the fastener "F" while the free end of the adapter bar 41 provides a handle for rotating the wrench 43 and fastener "F" in the directions indicated in FIG. 8 at 51 and 52. FIG. 9 illustrates a further application of the leverage adapter 40 attached to a chisel 53. In this application, the adapter 40 allows a user to hold the chisel 53 at a safe distance from a hammer 54 when striking the chisel 53 to remove the fastener "F".

Figure 10:
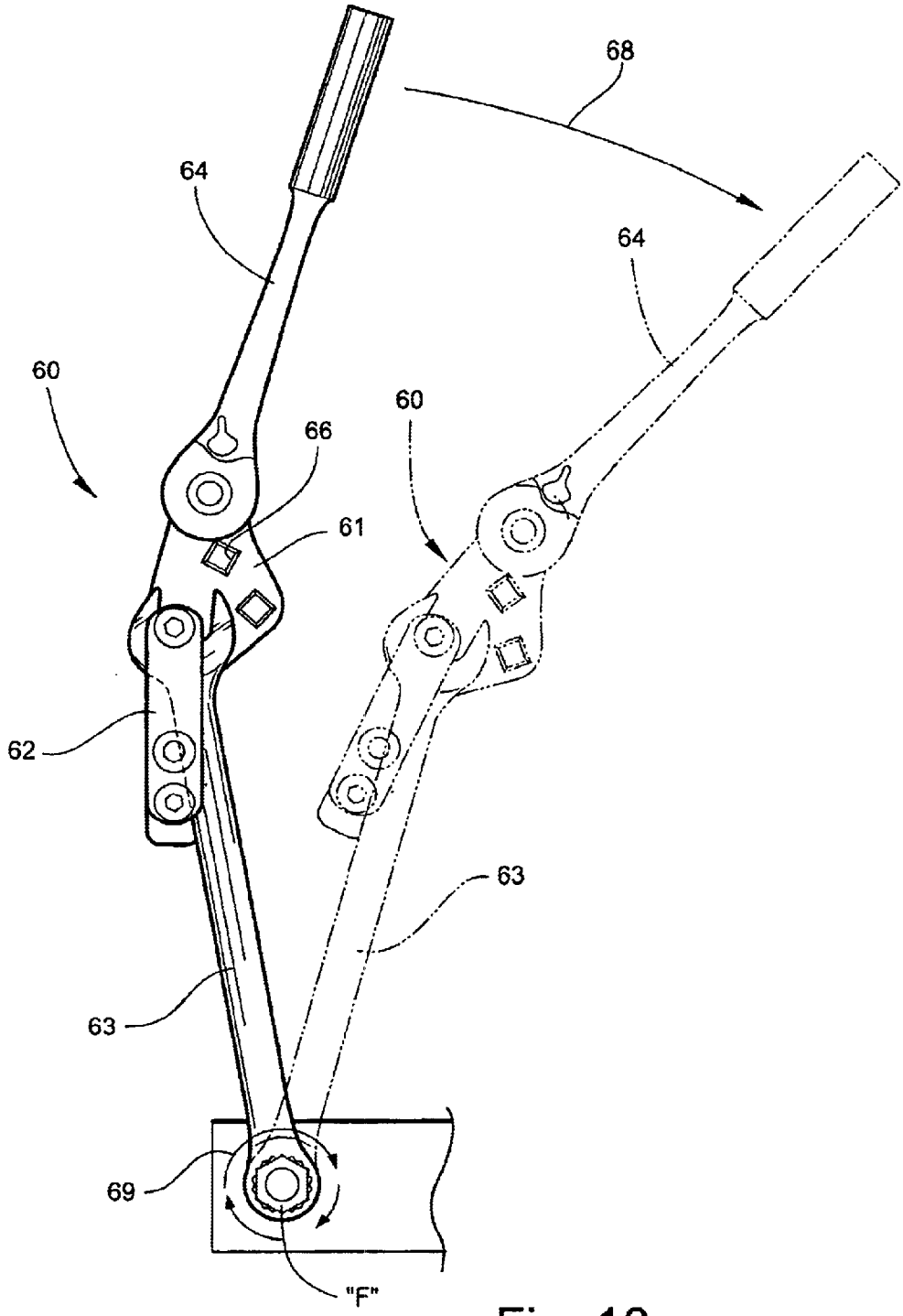
FIG. 10 is an environmental perspective view of a leverage adapter according to a third preferred embodiment of the present invention, and showing operation of the adapter in combination with a socket wrench.
Figure 11:
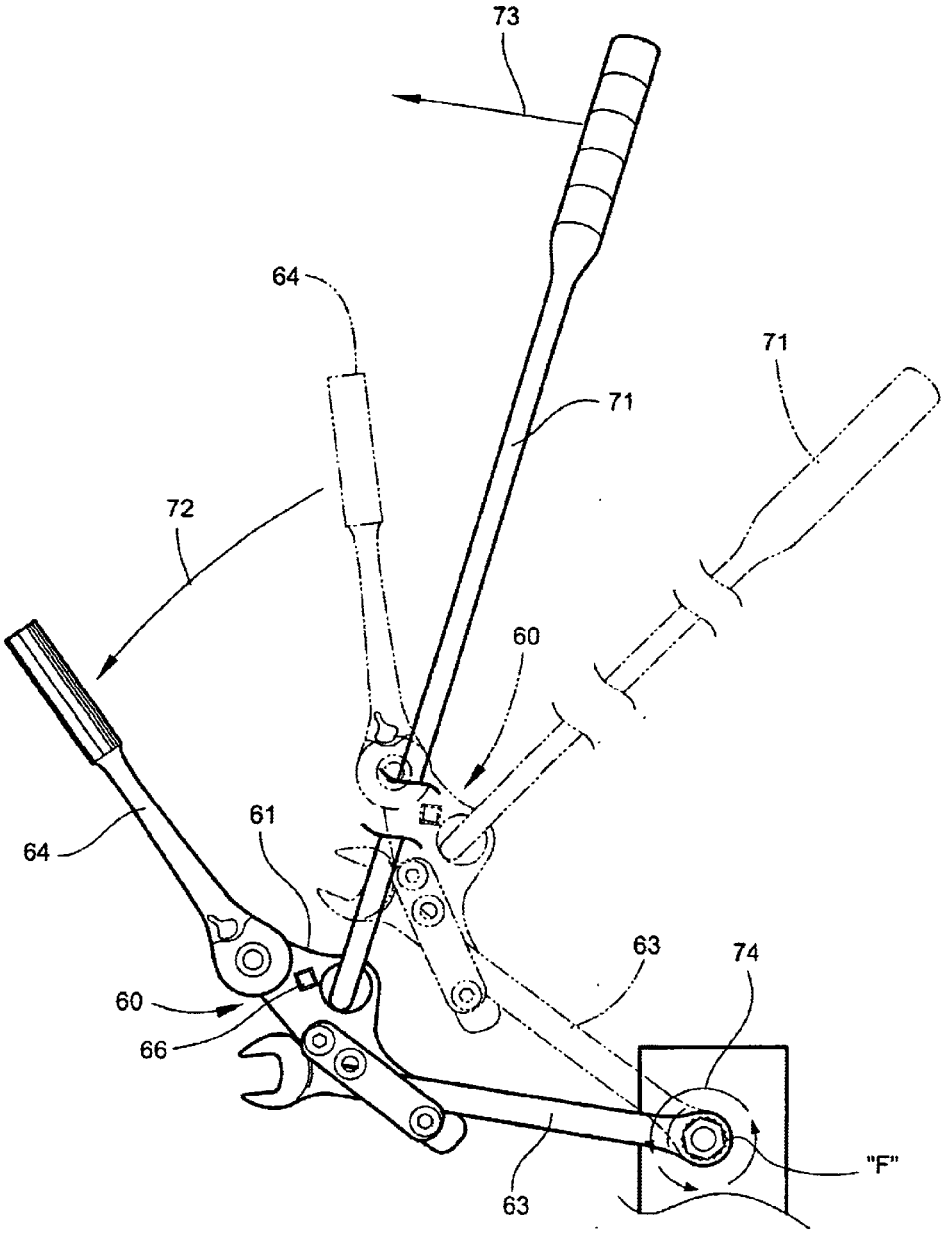
FIG. 11 is an environmental view demonstrating operation of the leverage adapter in combination with a socket wrench and draw bar.

FIGS. 10–13 illustrate various alternative applications of the invention according to a further preferred embodiment. Referring to FIGS. 10 and 11, the leverage adapter 60 includes a generally flat elongated adapter bar 61 and clamp bar 62 which cooperate when assembled to sandwich and secure one end of a wrench 63 to the adapter 60. The clamp bar 62 and adapter bar 61 are held together by pairs of complementary-threaded nuts and bolts, such as those previously described. After assembly, the opposite end of the wrench 63 is applied to the fastener "F" and a second hand tool, such as a socket wrench 64, is connected to the adapter bar 61 at one of the openings 66. The socket wrench 64 is then pulled in the direction indicated at 68, thus rotating the fastener "F" as indicated at 69. For still further leverage, a draw bar 71 may be connected to the adapter bar 61, as shown in FIG. 11, at another opening 66 and used in combination with the socket wrench 64. By pulling the wrench 64 and draw bar 71 in the directions indicated at 72 and 73, the fastener "F" is rotated as indicated at 74.

Figure 12:
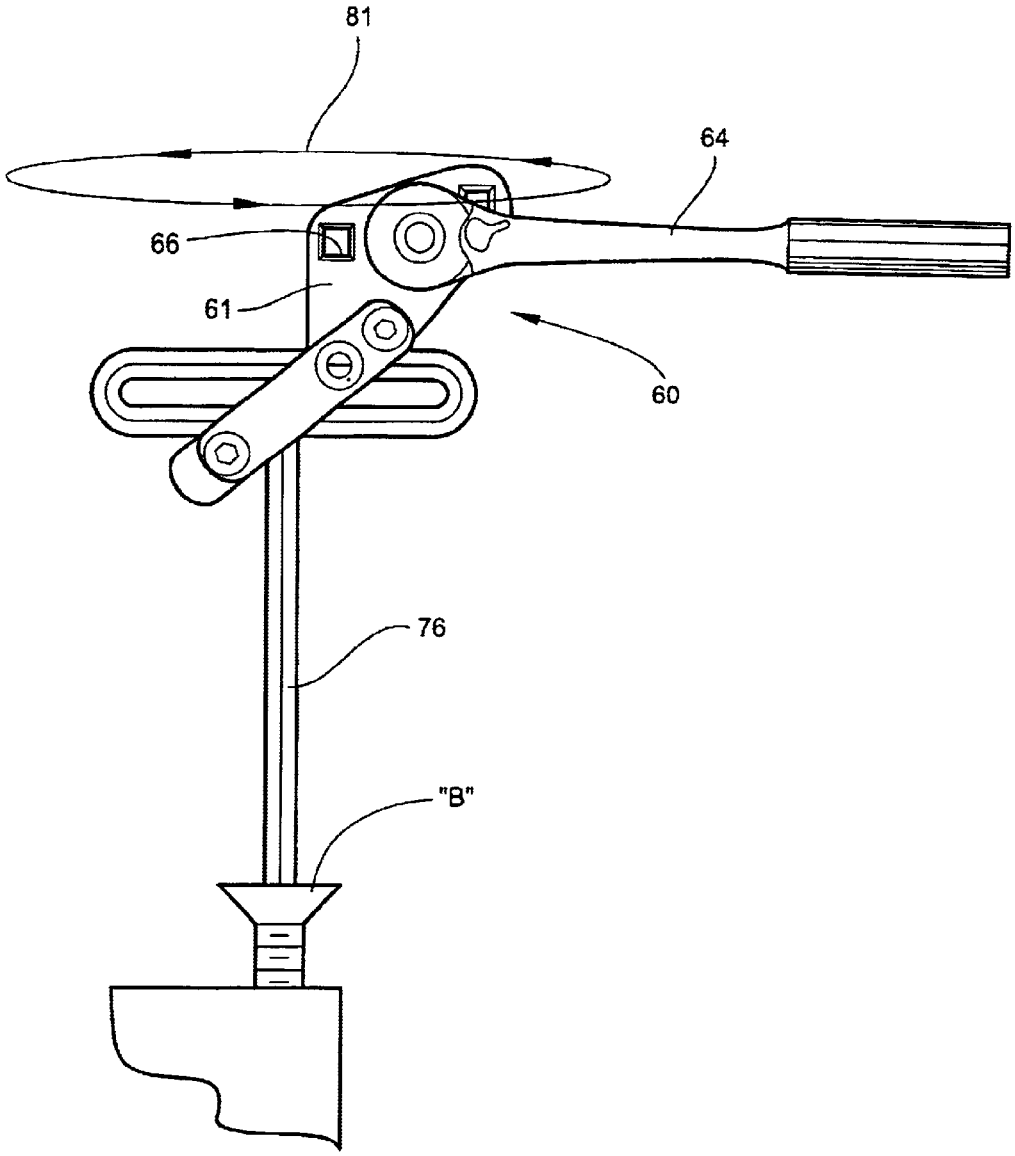
FIG. 12 is an environmental view demonstrating operation of the leverage adapter in combination with an Allan wrench.
Figure 13:
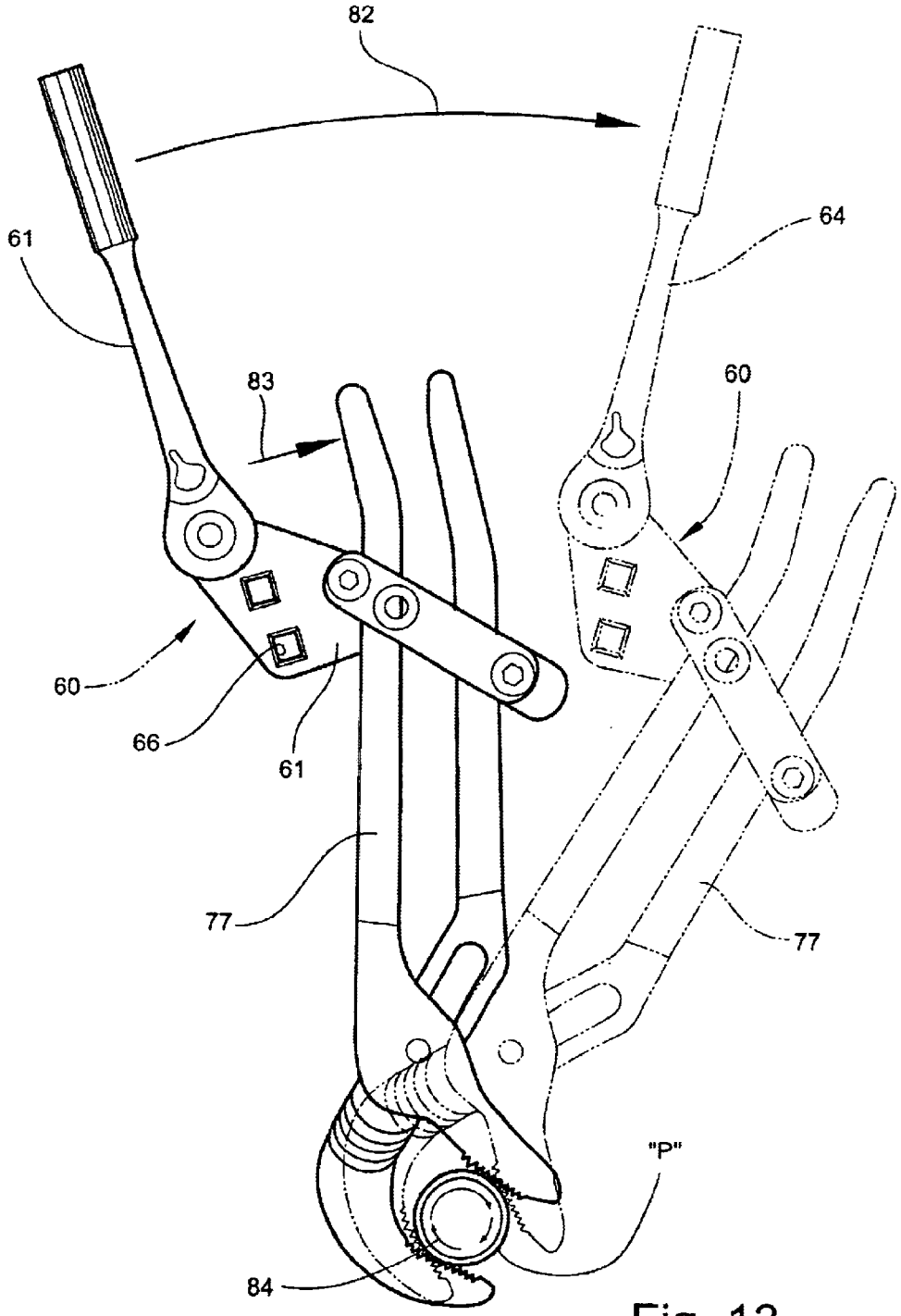
FIG. 13 is an environmental view demonstrating operation of the leverage adapter in combination with slip-joint pliers.

FIGS. 12 and 13 illustrate the leverage adapter 60 attached to handles of an Allen wrench 76 and slip-joint pliers 77, respectively. As shown in FIG. 12, the socket wrench 64 is connected to the adapter bar 61 at opening 66 and rotated as indicated at 81 to rotate the Allen bolt "B". In FIG. 13, the socket wrench 64 is pulled in the direction indicated at 82. This forces the handle of the pliers 77 closed, as indicated at 83, thus causing the jaws to tighten against the pipe "P". As the wrench 64 is further pulled, the pipe "P" rotates as indicated at 84.

A leverage adapter is described above. Various details of the invention may be changed without departing from its scope. Furthermore, the foregoing description of the preferred embodiment of the invention and best mode for practicing the invention are provided for the purpose of illustration only and not for the purpose of limitation—the invention being defined by the claims.

I claim:

1. A leverage adapter for use in combination with an elongated hand tool, the hand tool having a first end adapted for engaging an object and a second end opposite the first end, said leverage adapter comprising:

(a) an elongated adapter bar having first and second ends;

(b) means secured to the first end of said adapter bar for attaching said adapter bar to the second end of the hand tool, said attaching means comprising a cross-member extending longitudinally from the first end of said adapter bar towards the second end of said adapter bar; and (c) means formed with the second end of said adapter bar for receiving a leverage bar, the leverage bar, adapter bar, and hand tool cooperating to multiply a force applied by the user to the object to manipulate the object.

2. A leverage adapter according to claim 1, wherein said attaching means further comprises first and second arms cooperating with said cross-member to form a U-bolt extending through the first end of said adapter bar and adapted for engaging the second end of the hand tool to secure said adapter bar to the hand tool.

3. A leverage adapter according to claim 2, and comprising a pair of wing nuts applied to respective ends of said U-bolt.

4. A leverage adapter according to claim 1, wherein the second end of said adapter bar extends outwardly at an angle to the first end of said adapter bar.

5. A leverage adapter according to claim 1, wherein said means for receiving the leverage bar comprises a receptacle formed in the second end of said adapter bar.

6. A leverage adapter according to claim 5, wherein said receptacle is generally square.

7. A leverage adapter according to claim 1, wherein said adapter bar is constructed of metal.

8. A leverage assembly for use in combination with an elongated hand tool, the hand tool having a first end adapted for engaging an object and a second end opposite the first end, said leverage assembly comprising:

(a) an elongated adapter bar having first and second ends; and (b) means secured to the first end of said adapter bar for attaching said adapter bar to the second end of the hand tool, said attaching means comprising a cross-member extending longitudinally from the first end of said adapter bar towards the second end of said adapter bar.

9. A leverage assembly according to claim 8, wherein said means for attaching said adapter bar comprises a U-bolt extending through the first end of said adapter bar and adapted for engaging the second end of the hand tool to secure said adapter bar to the hand tool.

10. A leverage assembly according to claim 9, and comprising a pair of wing nuts applied to respective ends of said U-bolt.

11. A leverage assembly according to claim 8, wherein the second end of said adapter bar extends outwardly at an angle to the first end of said adapter bar.

12. A leverage assembly according to claim 8, wherein said means for receiving the leverage bar comprises a receptacle formed in the second end of said adapter bar.

13. A leverage assembly according to claim 12, wherein said receptacle is generally square.

14. A leverage assembly according to claim 13, wherein said leverage bar comprises a generally square head adapted for being received within the generally square receptacle of said adapter bar.

15. A leverage assembly according to claim 14, wherein the head of said leverage bar comprises a ratchet head.

16. A leverage assembly according to claim 8, wherein said adapter bar is constructed of metal.

* * * * *